United States Patent [19]

Skaggs

[11] 4,320,839

[45] Mar. 23, 1982

[54] PACKAGING INSERT

[75] Inventor: Boyd T. Skaggs, Louisville, Ky.

[73] Assignee: Container Corporation of America, Chicago, Ill.

[21] Appl. No.: 203,558

[22] Filed: Nov. 5, 1980

[51] Int. Cl.[3] ..... B65D 81/16; B65D 85/30

[52] U.S. Cl. ..... 206/591; 206/594; 206/45.14; 206/45.19; 229/34 HW

[58] Field of Search ..... 206/521, 591, 592, 593, 206/594, 45.14, 45.19; 229/34 HW

[56] References Cited

U.S. PATENT DOCUMENTS

| | | | |
|---|---|---|---|
| 1,981,731 | 11/1934 | Holy | 206/45.19 |
| 2,553,418 | 5/1951 | Loth | 206/591 |
| 2,965,275 | 12/1960 | Langford | 206/591 |
| 3,446,413 | 5/1969 | Sherrill et al. | 206/45.14 |
| 4,134,497 | 1/1979 | Dlugopolski | 206/521 |

*Primary Examiner*—William T. Dixson, Jr.

*Attorney, Agent, or Firm*—Richard W. Carpenter; Davis Chin

[57] ABSTRACT

A one-piece paperboard insert, for protecting an article enclosed within an outer container, including a hollow frame structure surrounding a deck structure.

5 Claims, 5 Drawing Figures

PACKAGING INSERT

SUMMARY OF THE INVENTION

This invention relates to packaging inserts, and more particularly to a device used alone or in association with similar devices for surrounding portions of an article to be packaged within an outer container for the purpose of protecting and cushioning the article and spacing the article from the walls of the container.

It is an object of the invention to provide, in an article of the type described, a one-piece, self-locking insert formed of paperboard which can be easily erected, either manually or on a machine, and placed in position against an article within an outer container.

A more specific object of the invention is the provision of a packaging insert, of the type described, which includes an outer frame structure having a plurality of interconnected hollow walls, and a deck structure extending between and occupying the space surrounded by the frame structure.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 5:
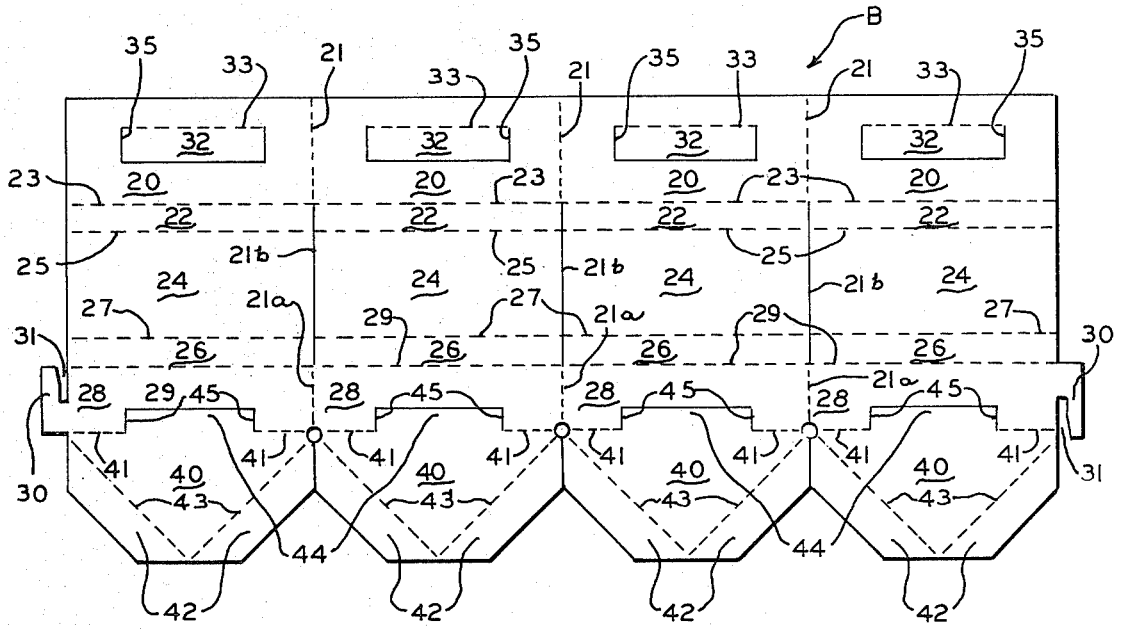
FIG. 5 is a plan view of a blank of foldable sheet material from which the insert illustrated in the other views may be formed.
Figure 3:
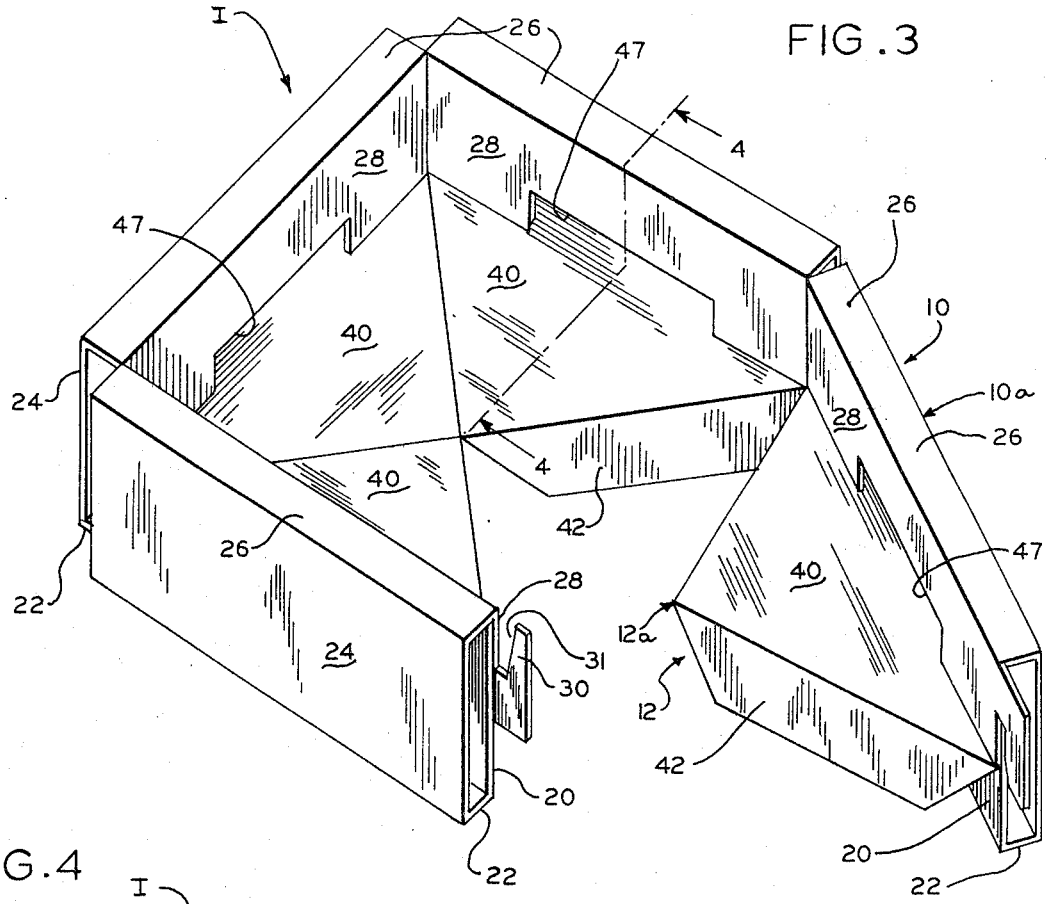
FIG. 3 is an enlarged view similar to FIGS. 1 and 2 but illustrating the manner in which the insert is assembled.

Referring now to the drawings for a better understanding of the invention, and particularly to FIG. 3, it will be seen that the novel packaging insert embodying features of the invention and indicated generally at I may be formed from a unitary blank B of foldable sheet material, such as paperboard, illustrated in FIG. 5.

Packaging insert I includes an outer frame structure 10 comprised of a plurality of hollow side walls 10*a* joined to each other at their ends, and a transversely extending deck structure 12 which includes a plurality of generally pie-shaped section 12*a*, which cooperate with each other to form a platform within the area surrounded by frame structure 10.

Each of the side walls 10*a*, as best seen in FIG. 3, includes an intermediate panel 20; a first edge panel 22 joined at an inner edge along fold line 21 to an adjacent edge of intermediate panel 20; an outer panel 24, joined at one edge along fold line 25 to an adjacent edge of edge panel 22; a second edge panel 26, joined along a fold line 27 to a related edge of outer panel 24; and an inner panel 28 joined at one edge on a fold line 29 to a related edge of second edge panel 26.

Figure 1:
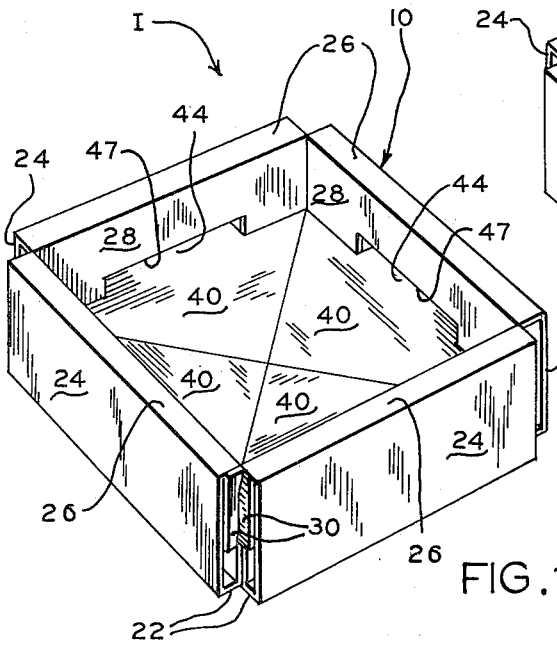
FIGS. 1 and 2 are perspective views of a packaging insert embodying features of the invention as seen from opposite sides.
Figure 2:
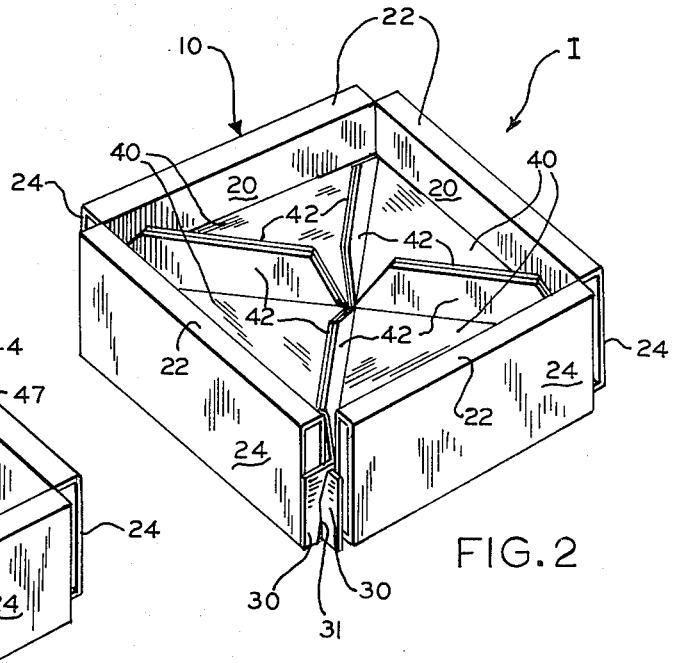
Figure 4:
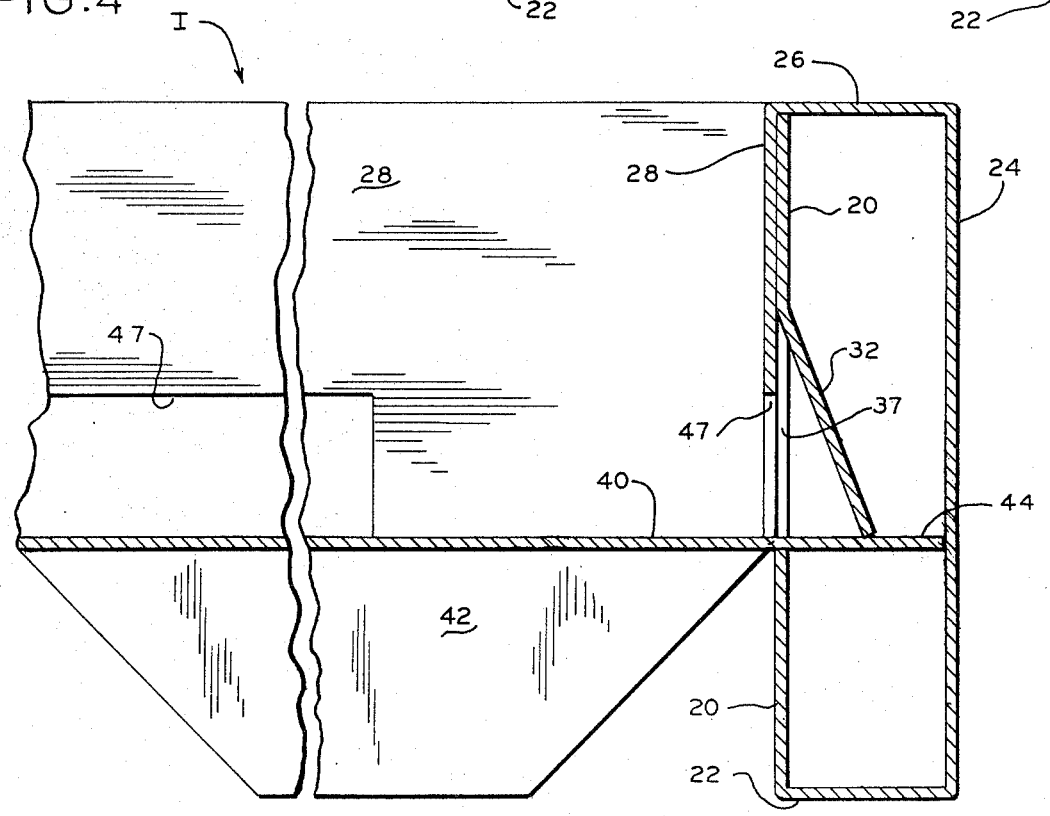
FIG. 4 is a fragmentary transverse section taken on line 4—4 of FIG. 3.

Portions of the side walls 10*a* are foldably joined to each other. As best seen in FIG. 5 adjacent edges of intermediate panels 20 are joined to each other on fold lines 21, and adjacent edges of inner panels 28 are foldably joined to each other on fold lines 21*a*. Again referring to both FIGS. 3 and 5, it will be seen that at each end of the blank B inner panels 28 are provided with outwardly projecting lock tabs 30, each of which has a recess 31, which are adapted to interlock with each other to join the free corners of the insert I, as best seen in FIGS. 1 and 2. It will also be noted, from an examination of FIG. 5, that each set of first edge panel 22, outer panel 24, and second edge panel 26 is separated from adjacent corresponding panels by a cut line 21*b*. It will be noted that each cut line 21*b* is an extension of or aligned with related fold lines 21 and 21*a*. As best seen in FIGS. 4 and 5 each of the intermediate panels 20 is provided with a lock flap 32 which is cut from the material of the panel 20 along a U-shaped cut line 35. As best seen in FIG. 4 when flap 32 is folded out of the plane of panel 20 there is formed in panel 20 an opening or recess 37, the purpose of which is described later in the specification. Each flap 32 is joined to panel 20 on fold line 33.

Again referring to FIG. 3, it will be seen that the deck structure 12 includes a plurality of similar pie-shaped sections 12*a* which are positioned adjacent each other to form a deck or platform and to occupy the space surrounded by the frame structure 10.

Each of the deck sections 12*a* includes a generally pie-shaped main panel 40 which is foldably joined at its outer edge, along a pair of spaced fold lines 41, to an adjacent edge of a related inner panel 28.

At its inner edges, each main panel 40 is provided with a pair of flanges or feet 42 which are foldably joined, along fold lines 43, to the edges of main panel 40 and which are disposed to extend normal thereto in face-to-face relation with similar flanges or feet 42 of adjacent main panels.

Again referring to FIG. 5, it will be seen that each of the main panels 40 is provided with an outwardly extending projection 44 which is cut from material of adjacent inner panel 28 and defined by a cut line 45.

Again referring to FIG. 4, it will be seen that an opening 47 is provided in each inner panel 28. This opening is formed by the material which was used to form extension 44.

In order to form the insert I from the blank B, the side wall panels 20, 22, 24, 26, and 28 are folded into position to define hollow side walls all aligned with each other. The panels are then folded toward each other to the position shown in FIG. 3, and at the same time the main panels are folded to a position normal to the side walls with the extensions 44 of each main panel 40 protruding through openings 47 and 37 in inner and intermediate panels 28 and 20, respectively. At the same time this is done the flanges 42 are folded at right angles to their related main panels 40, with the flanges of adjacent panels being placed in face-to-face relation.

Thus, when the adjacent lock tabs 30 are engaged in interlocking relationship a rigid structure is provided.

It will be appreciated that the packaging insert may be readily assembled manually from a one-piece blank of foldable paperboard, and that the insert does not require any stitching, stapling, or other outside securing means to maintain it in rigid interlock assembled condition.

I claim:

1. A self-locking insert for cushioning a packaged article and spacing it from the walls of an outer container, said insert being formed from a unitary blank of foldable sheet material such as paperboard, and comprising:

(a) an outer frame member including a plurality of hollow walls interconnected at their ends;

(b) each of said hollow walls comprising an intermediate panel, a first edge panel, an outer panel, a second edge panel, and an inner panel foldably joined to each other to form a hollow rectilinear structure;

(c) a deck member extending between said hollow walls intermediate the planes of said first and second edge panels and including a plurality of pie-shaped sections disposed adjacent each other;

(d) each of said deck member sections comprising:

(i) a main panel foldably joined at an outer side edge to an adjacent edge of a related hollow wall inner panel and extending inward therefrom and normal thereto;

(ii) a pair of flange panels foldably joined to inner edges of said main panel and extending normal thereto in face-to-face relation with flange panels of adjacent main panels.

2. An insert according to claim 1, wherein certain of said hollow walls have adjacent portions foldably joined to each other, and certain other of said hollow walls have interlocking engagement with each other.

3. An insert according to claim 1, wherein the inner panels of each hollow wall are approximately one half of the height of the related intermediate and outer panels of said hollow wall.

4. An insert according to claim 1, wherein each of said deck member main panels has an integral projection extending outwardly through adjacent openings in related inner and intermediate panels of a related hollow wall.

5. An insert according to claim 4, wherein each of said hollow wall intermediate panels has a lock flap foldably joined thereto and extending against a projection of a related deck member main panel to maintain said projection snugly within said openings.

* * * * *